US006386661B1

(12) United States Patent
Woerner

(10) Patent No.: US 6,386,661 B1
(45) Date of Patent: May 14, 2002

(54) GUIDE RAIL FOR REAR MOUNTED DRAWER SLIDE ASSEMBLIES

(75) Inventor: Axel G. Woerner, Jamestown, NC (US)

(73) Assignee: Hafele America Co., Archdale, NC (US)

( * ) Notice: Subject to any disclaimer, the term of this patent is extended or adjusted under 35 U.S.C. 154(b) by 0 days.

(21) Appl. No.: 09/580,288

(22) Filed: May 30, 2000

(51) Int. Cl.[7] ..... A47B 88/00
(52) U.S. Cl. ..... 312/334.5; 312/334.1
(58) Field of Search ..... 312/334.1, 334.5, 312/334.7, 334.18, 334.27, 334.33, 334.34, 330.1, 334.23, 334.24, 334.28; 384/19, 20, 22

(56) References Cited

U.S. PATENT DOCUMENTS 3,328,107 A * 6/1967 Gutner ..... 312/334.27 X
3,826,554 A 7/1974 Cornell ..... 312/330.1
4,141,525 A 2/1979 Miller
4,863,288 A 9/1989 Houck ..... 384/19
5,257,861 A 11/1993 Domenig et al. ..... 312/334.5
5,359,752 A 11/1994 Domenig
5,387,033 A 2/1995 Domenig ..... 312/334.5
5,636,820 A 6/1997 Domenig ..... 248/220.21
5,692,816 A 12/1997 Lai ..... 312/334.4

* cited by examiner

*Primary Examiner*—James O. Hansen
(74) *Attorney, Agent, or Firm*—Womble Carlyle Sandridge & Rice, PLLC

(57) ABSTRACT

A guide rail for rear-mounted drawer slide assemblies of the type attached to the rear wall of cabinets, having an elongated side wall with front and rear ends, a front mounting surface parallel to the side wall for mounting to a drawer cabinet front wall, and an extension member with a radially outwardly extending tongue for connecting the guide rail to a cabinet rear wall by inserting the extension member and tongue through the rear of the cabinet.

5 Claims, 3 Drawing Sheets

GUIDE RAIL FOR REAR MOUNTED DRAWER SLIDE ASSEMBLIES

FIELD OF THE INVENTION

The present invention relates generally to rear-mounted drawer slides, and particularly, to improved drawer slide guide rails for rear-mounted drawer slides.

BACKGROUND OF THE INVENTION

For many years, furniture manufacturers have used rear-mounted drawer slide assemblies with certain cabinet configurations to achieve smooth, even, drawer opening and closing. These drawer slide assemblies typically consist of left and right pairs of drawer runners and guide rails. The guide rails are secured to the rear wall of the furniture cabinet.

In recognition of the dimensional imprecision and other variables inherent in a manufacturing environment, various types of rear mounting brackets have been developed to mount the rear end of the guide rail, thus ensuring a proper alignment of the drawers within a cabinet at the time of manufacture as well as permitting periodic adjustment during the life of the furniture. While these brackets have been satisfactory to a degree, they suffer from inherent looseness and slippage problems resulting from tolerances in their own manufacture, inadequate installation, and unavoidable wear over the lifetime of the product. These brackets while simply designed and manufactured without great precision, are low cost items that wear quickly and frequently break when subjected to routine drawer openings and closings. Additionally, the mere use of mounting brackets and other hardware requires that furniture manufacturers maintain a sizeable inventory of brackets and fasteners, thus requiring additional space and carrying costs.

While the mounting brackets described hereinabove permit lateral adjustments of side-mounted guide rails, they provide no solution to manufacturing variations in drawer cabinet depths. Thus, where a cabinet is constructed shallower than prescribed, the guide rails may be too long and if the cabinets are deeper than prescribed, the guide rails are not long enough. Accordingly, rework or rejection of the cabinet may result or item-by-item modifications to existing hardware may be required.

The prior art discloses a universal drawer slide mounting bracket for assembling drawer rail assemblies in multiple positions. However, this universal bracket still requires additional installation hardware. There are known laterally adjustable mounting brackets for use with both tongueless drawer guides and those having laterally formed tongues. There is also known a guide rail mounting bracket that utilizes teeth for enhancing the degree of grip between the bracket and the guide rail. However, these still require the furniture manufacturer to maintain an additional inventory of such parts for use with side-mounted drawer assemblies, and because of their unique constructions, do not have universal utility. Further, they offer no solution to the variations in drawer cabinet depths.

SUMMARY OF THE INVENTION

The present invention is directed to a rear-mounted guide rail which compensates for out of square drawers or cabinets by making lateral adjustments to the guide rail, without the need for tools or special laterally adjustable mounting brackets, after the guide rail is installed in a cabinet and as may be needed over the lifetime of the piece of furniture. A further aspect of the present invention is to provide such a rear-mounted guide rail that can be mounted to the rear of a cabinet without the need for any form of rear mounting bracket or other hardware and that can compensate for minor variances between the cabinet front and rear walls.

Accordingly, one aspect of the present invention is to provide a laterally adjustable guide rail that includes an elongated side wall having a mounting surface at the front end for connecting the front end to a cabinet front surface and a rear extension member for connecting the drawer slide to the rear wall of the cabinet. A roller may be attached to the side wall outer surface to facilitate opening and closing movement of the associated drawer slide or runner. By inserting the rear extension member through the cabinet rear wall, the need for a rear mounting bracket is eliminated. Further, the rear extension member is of sufficient length to accommodate inaccuracies and manufacturing tolerances in the depth of the cabinet. An extension member that is about three-quarters of an inch long is suitable for this purpose; however, shorter or longer extension members may be chosen, depending upon the specific application.

Another aspect of the present invention is to provide a laterally adjustable guide rail that includes an elongated side wall having upper and lower flanges and front and rear ends for mounting the guide rail to the cabinet front and rear walls. Substantially vertically aligned notches formed in the upper and lower flanges, and extending substantially the width of the flanges, permit simple, flexible adjustments of the installed guide rail. Desirably, the notches are U or V-shaped.

These and other aspects of the present invention will become apparent to those skilled in the art after reading the following description of the preferred embodiment when considered with the drawings.

DESCRIPTION OF THE PREFERRED EMBODIMENTS

Figure 1:
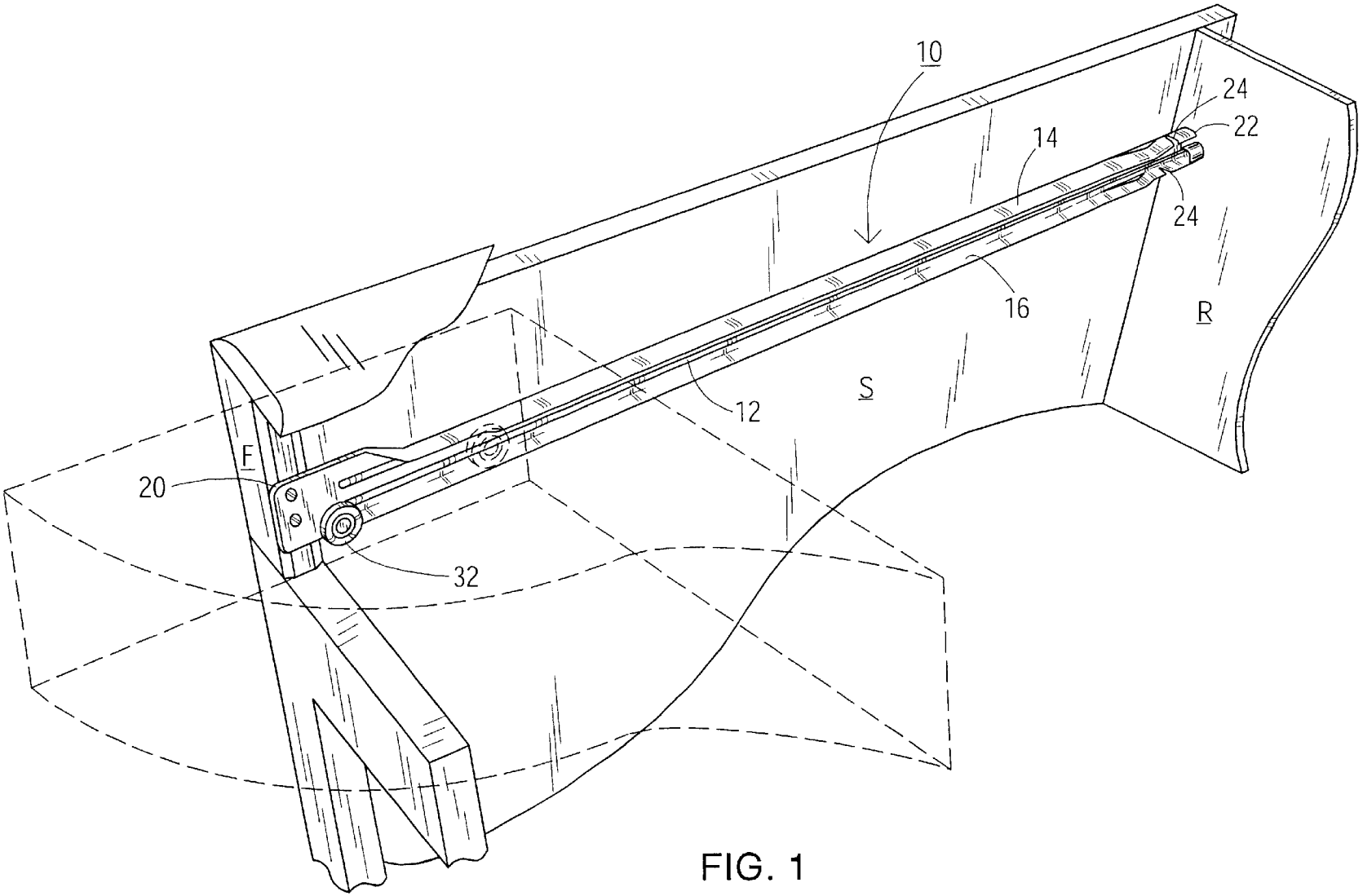
FIG. 1 is an environmental front perspective view of a guide rail constructed according present invention.
Figure 3:
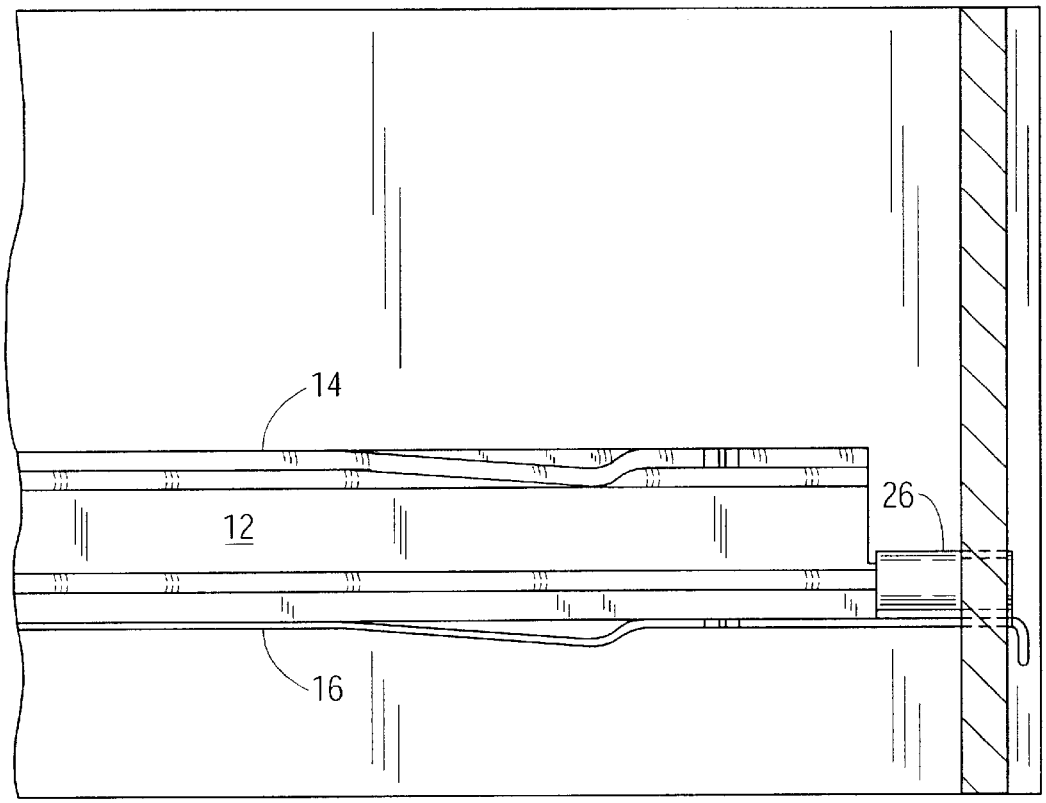
FIG. 3 is a rear side view of the guide rail of FIG. 1.

Referring now to the drawings in general and FIG. 1 in particular, it will be understood that the illustrations are for the purpose of describing a preferred embodiment of the invention and are not intended to limit the invention thereto. As best seen in FIGS. 1 and 3, a rear-mounted guide rail constructed according to the present invention, generally designated 10, includes an elongated side wall 12 having upper and lower flanges 14, 16, front edge 20 and rear edge 22. Desirably, guide rail 10 is formed from a substantially rigid bendable metallic material such as aluminum or steel, but other suitable metallic compositions or alloys may be used. The front end 20 of guide rail 10 may be attached to a front surface of a drawer cabinet frame (designated F in FIG. 1) with conventional fasteners such as screws, nails, or the like. A roller 32 may be attached to front end 20 for rollably receiving a drawer slide rail (not shown). The rear end 22 may also be connected to the drawer cabinet rear surface (designated R in FIG. 1) with mounting brackets or other suitable fasteners. This configuration of side wall 12, flanges 14, 16, and front edge 20 is conventional.

Figure 2:
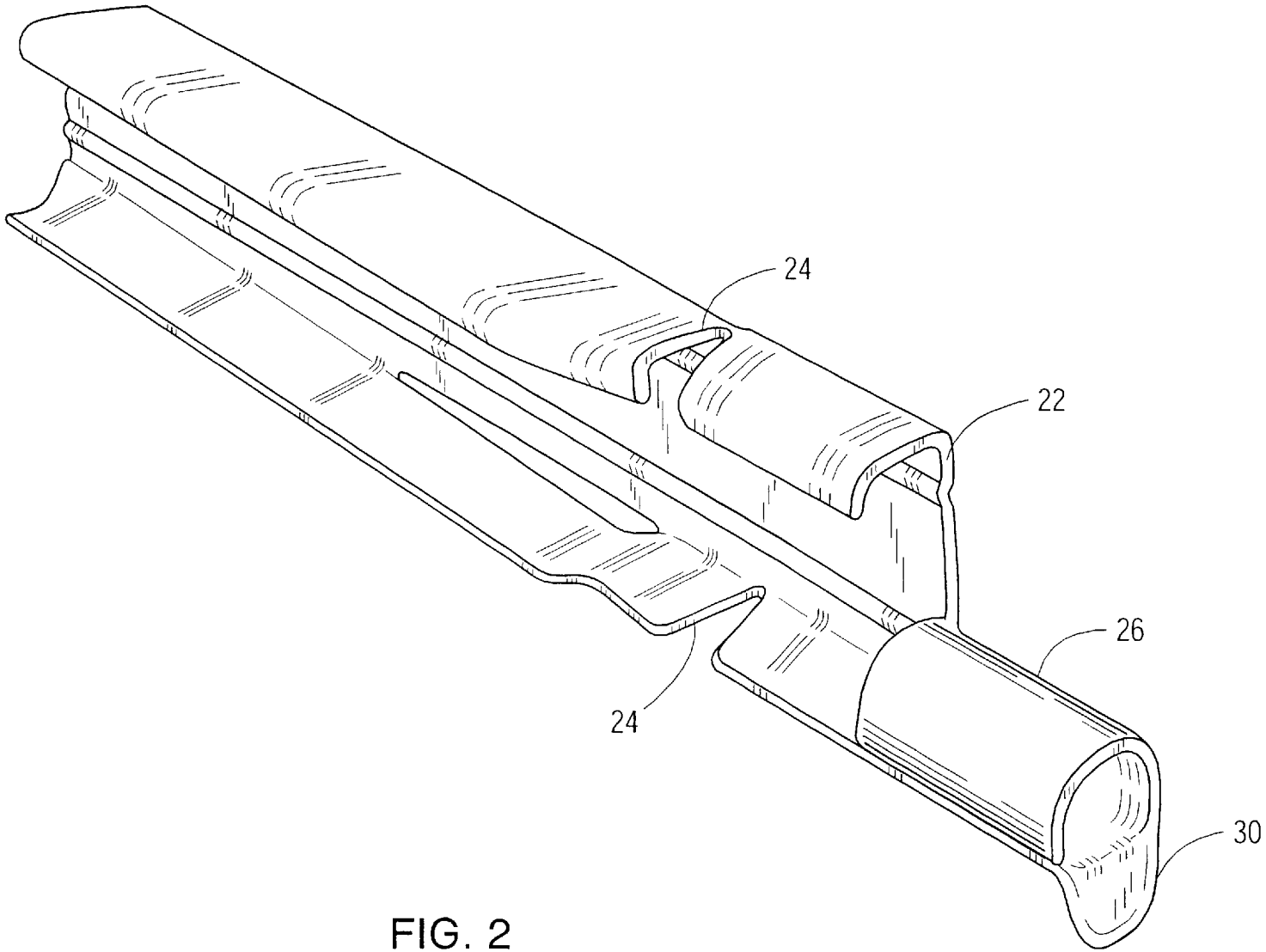
FIG. 2 is an enlarged rear perspective view of the guide rail of FIG. 1 illustrating the notches in the flanges, and the rear extension member.

As best seen in FIGS. 2 and 3, the preferred embodiment of guide rail 10 includes an extension member 26 extending parallel to elongated side wall 12 and rearwardly from rear end 22. Extension member 26 is formed by vertically cutting through a substantial portion of the rear end of side wall 12 and rolling that portion into a generally cylindrical shape having an axis parallel to the primary axis of guide rail 10. An end portion of lower flange 16 may be bent downward to form a tongue portion 30. Thus, the extension member is preferably generally cylindrical in shape, but alternatively could be flat or any other shape suitable for connecting guide rail 10 to the rear of a cabinet. As shown in FIG. 3, extension member 26 connects guide rail 10 to the cabinet rear wall by insertion therethrough an opening therein. This eliminates the requirement for additional mounting brackets or hardware.

Extension member 26 is further dimensioned to give the guide rail a variable effective length such that it may be readily connected through drawer cabinet rear surfaces having unequal left and right cabinet depths due to defects and tolerances in the cabinet depth introduced during manufacture, thus eliminating the need for rework or rejection of the cabinet. An extension member 26 that is about three-quarters of an inch long is suitable for this purpose; however, shorter or longer extension members may be chosen, depending upon the specific application. Once inserted through the cabinet rear surface, the tongue portion 30, which extends radially outward from extension member 26, ensures that guide rail 10 will not slide out or otherwise become unconnected from the rear of the cabinet due to repetitive opening and closing forces being exerted on the drawer.

Figures 4A, 4B, 4C:
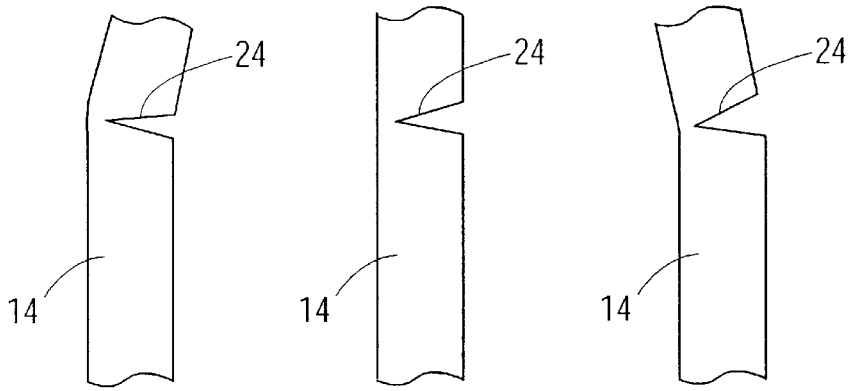
FIG. 4A is a schematic of a top view of a guide rail constructed according to the preset invention showing how the guide rail can be flexed laterally toward a cabinet side wall.
FIG. 4B is a schematic of a top view of a guide rail constructed according to the present invention showing the guide unflexed.
FIG. 4C is a schematic of a top view of a guide rail constructed according to the present invention showing how the guide rail can be flexed laterally toward the drawer.

As seen in FIGS. 1 and 2, the preferred embodiment of the present invention includes notches 24 formed in flanges 14, 16 for flexibly adjusting guide rail 10 following installation. Once guide rail 10 is mounted in the cabinet structure, minor manufacturing or installation defects and inaccuracies may create an uneven, or unsquare, relationship between the drawer and the cabinet. By pressing or pulling laterally on guide rail 10 at notches 24, guide rail 10 can be easily bent at the notches to restore evenness or squareness to the drawer and cabinet configuration. As shown in FIGS. 4A and 4C, guide rail 10 can be bent laterally either toward or away from the cabinet side wall (designated S in FIG. 1) or be left unbent as shown in FIG. 4B when no adjustments are necessary. Desirably, notches 24 are V-shaped for enhanced pivotal flexibility and extend substantially through the width of flanges 14, 16, allowing a greater range of adjustment.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A guide rail for rear-mounted drawer slide assemblies comprising:

(a) an elongated side wall having upper and lower flanges and front and rear ends, said flanges extending inwardly from said side wall;

(b) notches formed in said flanges extending substantially the width thereof, said notches substantially vertically aligned therein whereby flexing of the side wall permitted by the notches provides for lateral adjustment of said guide rail after installation thereof, and (c) an extension member protruding rearwardly from the rear end of said guide rail a prescribed distance greater than the thickness of a cabinet rear wall, wherein said extension member is capable of connecting said guide rail to a cabinet rear wall by insertion therethrough when installed.

2. The guide rail of claim 1 wherein said notches are substantially V-shaped.

3. The guide rail of claim 1 whereby said extension member includes a tongue portion extending radially outward from the terminal end thereof to prevent forward movement of the guide rail after installation.

4. A laterally adjustable guide rail for rear-mounted drawer slide assemblies of the type attached to the rear wall of cabinets comprising:

(a) an elongated side wall having upper and lower flanges and front and rear ends, said flanges extending inwardly from said side wall; and (b) notches formed in said flanges extending substantially through the width thereof, said notches substantially vertically aligned therein whereby flexing of the side wall permitted by the notches provides for lateral adjustment of said guide rail after installation thereof.

5. The guide rail of claim 4 wherein said notches are substantially V-shaped.

* * * * *